US008649944B2

(12) United States Patent
Hayashi et al.

(10) Patent No.: US 8,649,944 B2
(45) Date of Patent: Feb. 11, 2014

(54) BLADE CONTROL SYSTEM, CONSTRUCTION MACHINE AND BLADE CONTROL METHOD

(75) Inventors: Kazuhiko Hayashi, Komatsu (JP); Kenjiro Shimada, Komatsu (JP); Kenji Okamoto, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 68 days.

(21) Appl. No.: 13/267,041

(22) Filed: Oct. 6, 2011

(65) Prior Publication Data

US 2013/0090817 A1 Apr. 11, 2013

(51) Int. Cl.
*G06F 7/70* (2006.01)

(52) U.S. Cl.
USPC ..... 701/50; 172/4.5; 172/12; 37/235

(58) Field of Classification Search
USPC ..... 701/49, 50; 172/4.5, 9, 12, 27, 35; 37/235
See application file for complete search history.

(56) References Cited

U.S. PATENT DOCUMENTS

| | | | | |
|---|---|---|---|---|
| 5,621,643 | A | | 4/1997 | Nakagami et al. |
| 5,951,613 | A | | 9/1999 | Sahm et al. |
| 6,068,060 | A | | 5/2000 | Ohtomo et al. |
| 6,129,158 | A | * | 10/2000 | Yamamoto et al. ..... 172/812 |
| 2013/0085644 | A1 | * | 4/2013 | Hayashi et al. ..... 701/50 |

FOREIGN PATENT DOCUMENTS

| | | | |
|---|---|---|---|
| JP | 5-106239 | A | 4/1993 |
| JP | 06-15775 | B2 | 3/1994 |
| JP | 10-141955 | A | 5/1998 |
| JP | 10-147952 | A | 6/1998 |
| JP | 11-256620 | A | 9/1999 |
| JP | 3305497 | B2 | 7/2002 |

OTHER PUBLICATIONS

International Search Report of corresponding PCT Application No. PCT/JP2012/073151 dated Dec. 18, 2012.

* cited by examiner

*Primary Examiner* — Gertrude Arthur Jeanglaude
(74) *Attorney, Agent, or Firm* — Global IP Counselors, LLP

(57) ABSTRACT

A blade system of the present invention includes: a blade angle calculating part configured to calculate sum of a forwardly tilting angle of a vehicle body with respect to a reference surface and a blade lifting angle of a lift frame with respect to a reference position; a difference angle calculating part configured to calculate a difference angle by subtracting a predetermined angle from the sum of the forwardly tilting angle and the blade lifting angle; an opening ratio setting part configured to set an opening ratio of a proportional control valve based on the difference angle; and a lift controlling part configured to control the proportional control valve in accordance with the opening ratio set by the opening ratio setting part until a predetermined period of time is elapsed after onset of dozing by a blade.

8 Claims, 7 Drawing Sheets

BLADE CONTROL SYSTEM, CONSTRUCTION MACHINE AND BLADE CONTROL METHOD

BACKGROUND

1. Technical Field

The present invention relates to a blade control system, a construction machine and a blade control method.

2. Description of the Related Art

Well-known dozing controls, having been proposed for a construction machine (e.g., a bulldozer or a motor grader), are intended to efficiently execute a dozing operation and are configured to automatically regulate the vertical position of a blade for keeping load acting on the blade (hereinafter referred to as "blade load") at a target value (e.g., see Japan Laid-open Patent Application Publication No. JP-A-H05-106239.

SUMMARY

However, the method described in the publication No. JP-A-H05-106239 has a drawback that an efficient dozing operation is prevented when the construction machine acutely slants on the onset of dozing. Specifically, when the construction machine enters a dug slope formed from a starting point of dozing (i.e., a position where a cutting edge of a blade is shoved), since the entire construction machine acutely slants forwards and the blade is accordingly deeply shoved into ground, the blade load is herein rapidly increased. Therefore, earth and sand held by the blade may be scattered around the construction machine because the blade is rapidly driven upwards under the aforementioned dozing control.

The present invention has been produced in view of the above drawback and is intended to provide a blade control system, a construction machine and a blade control method for executing efficient dozing.

A blade control system according to a first aspect of the present invention includes a lift frame vertically pivotably attached to a vehicle body; a blade attached to a tip of the lift frame; a lift cylinder configured to vertically drive the lift frame; a control valve configured to supply a hydraulic oil to the lift cylinder; a blade angle calculating part configured to calculate sum of a forwardly tilting angle of the vehicle body with respect to a reference surface and a blade lifting angle of the lift frame with respect to a reference position; a difference angle calculating part configured to calculate a difference angle by subtracting a predetermined angle from the sum of the forwardly tilting angle and the blade lifting angle; an opening ratio setting part configured to set an opening ratio of the control valve based on the difference angle; and a lift controlling part configured to control the control valve in accordance with the opening ratio set by the opening ratio setting part until a predetermined period of time is elapsed from an onset of dozing by the blade.

According to the blade control system of the first aspect of the present invention, since the blade control is executed in consideration of the forwardly tilting angle, the blade can be promptly and appropriately elevated when a bulldozer enters a dug slope and slants forwards. Accordingly, since it is possible to inhibit a blade load from being abruptly increased due to the blade deeply shoved into the ground, abrupt driving of the blade can be inhibited compared to a case that the blade control is executed in accordance with the blade load. Consequently, it is possible to inhibit earth and sand from being scattered around the bulldozer, thereby dozing can be efficiently executed.

A blade control system according to a second aspect of the present invention relating to the first aspect of the present invention further includes a determining part configured to determine whether or not the lift frame is positioned higher than the reference position and simultaneously a load acting on the blade is less than a predetermined value, wherein when the dozing by the blade is actually started and the determining part determines that the lift frame is positioned higher than the reference position and simultaneously the load acting on the blade is less than the predetermined value, the open ratio setting part is configured to set the open ratio of the control valve to be greater than the opening ratio set when the determining part determines that the lift frame is not positioned higher than the reference position or the load acting on the blade is not less than the predetermined value.

According to the blade control system of the second aspect of the present invention, the blade can be promptly lowered. Therefore, dozing can be more efficiently executed.

A blade control system according to a third aspect of the present invention relating to the first aspect further includes a blade load obtaining part configured to obtain a blade load acting on the blade. The lift controlling part is configured to control the opening ratio of the control valve in accordance with a difference between the blade load and a target load after the predetermined period of time is elapsed from the onset of dozing by the blade.

According to the blade control system of the third aspect of the present invention, scattering of earth and sand can be inhibited immediately after the onset of dozing, and thereafter, dozing can be efficiently executed based on the difference between the blade load and the target load.

A blade control system according to a fourth aspect of the present invention relating to the first aspect includes a blade load obtaining part configured to obtain a blade load acting on the blade. The lift controlling part is configured to control the opening ratio of the control valve in accordance with a difference between the blade load and a target load when the blade load is greater than a predetermined threshold continuously for a predetermined period of time from the onset of dozing by the blade.

According to the blade control system of the fourth aspect of the present invention, scattering of earth and sand can be inhibited immediately after the onset of dozing, and thereafter, dozing can be efficiently executed based on the difference between the blade load and the target load.

A construction machine according to a fifth aspect of the present invention includes a vehicle body and the blade control system according to one of the first to fourth aspects of the present invention.

A construction machine according to a sixth aspect of the present invention relating to the fifth aspect further includes a drive unit having a pair of tracks attached to the vehicle body.

A blade control method according to a seventh aspect of the present invention is configured to regulate a blade lifting angle of a lift frame vertically pivotably attached to a vehicle body with respect to a reference position for allowing sum of the blade lifting angle and a forwardly tilt angle of the vehicle body with respect to a reference surface to fall in a predetermined angular range until a predetermined period of time is elapsed from an onset of dozing by a blade attached to a tip of the lift frame.

In a blade control method according to an eighth aspect of the present invention relating to the seventh aspect, the lift frame is lowered for allowing the sum of the blade lifting angle and the forwardly tilt angle to be a predetermined angle until the predetermined period of time is elapsed from the onset of dozing by the blade.

BRIEF DESCRIPTION OF THE DRAWINGS

Referring now to the attached drawings which form a part of this original disclosure.

DETAILED DESCRIPTION OF THE EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

With reference to attached figures, a bulldozer will be hereinafter explained as an exemplary "construction machine". In the following explanation, the terms "up", "down", "front", "rear", "right" and "left" and their related terms should be understood as directions seen from an operator seated on an operator's seat.

Overall Structure of Bulldozer 100

Figure 1:
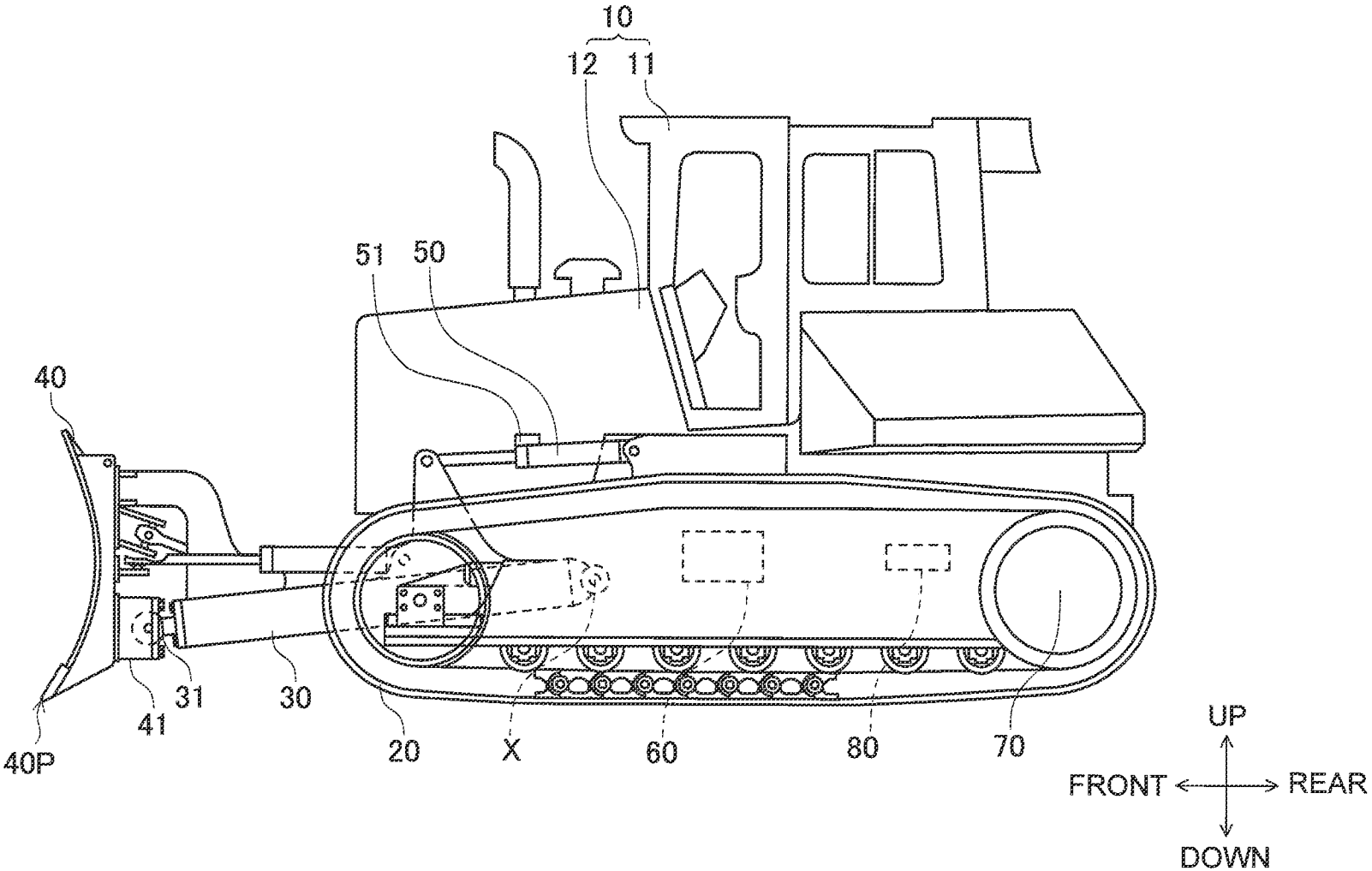
FIG. 1 is a side view of the entire structure of a bulldozer.

FIG. 1 is a side view of the entire structure of a bulldozer 100 according to an exemplary embodiment of the present invention.

The bulldozer 100 includes a vehicle body 10, a drive unit 20, a lift frame 30, a blade 40, a lift cylinder 50, an IMU (Inertial Measurement Unit) 60, a pair of sprocket wheels 70 and a driving torque sensor 80. Further, the bulldozer 100 is embedded with a blade control system 200. The structure and actions of the blade control system 200 will be hereinafter described.

The vehicle body 10 includes a cab 11 and an engine compartment 12. Although not illustrated in the figures, the cab 11 is equipped with a seat and a variety of operating devices. The engine compartment 12 is disposed forwards of the cab 11 for accommodating an engine (not illustrated in the figures).

The drive unit 20 is formed by a pair of tracks (only the left-side one is illustrated in FIG. 1), and the drive unit 20 is attached to the bottom of the vehicle body 10. The drive unit 20 is configured to be rotated by the pair of sprocket wheels 70.

The lift frame 30 is disposed inwards of the drive unit 20 in the right-and-left direction of the bulldozer 100. The lift frame 30 is attached to the vehicle body 10 while being up-and-down directionally pivotable about an axis X arranged in parallel to the right-and-left direction of the bulldozer 100. The lift frame 30 supports the blade 40 through a ball-and-socket joint 31.

The blade 40 is disposed forwards of the vehicle body 10. The blade 40 is supported by the lift frame 30 through a universal coupling 41 coupled to the ball-and-socket joint 31. The blade 40 is configured to be lifted up or down in conjunction with upward or downward pivot of the lift frame 30. The blade 40 includes a cutting edge 40P on the bottom end thereof The cutting edge 40P is shoved into the ground in dozing or grading.

The lift cylinder 50 is coupled to the vehicle body 10 and the lift frame 30. In conjunction with extension or contraction of the lift cylinder 50, the lift frame 30 is configured to pivot up and down about the axis X. The lift cylinder 50 includes a lift cylinder sensor 51 which is configured to detect the stroke length of the lift cylinder 50 (hereinafter referred to as "a lift cylinder length L"). Although not illustrated in the figures, the lift cylinder sensor 51 is formed by a rotatable roller which is configured to detect the position of a cylinder rod and a magnetic sensor which is configured to return the cylinder rod to the original position. The lift cylinder sensor 51 is configured to inform a blade controller 210 to be described (see FIG. 2) of the lift cylinder length L.

The IMU 60 is configured to obtain vehicle body tilting angle data indicating vehicle body tilting angles in the longitudinal and right-and-left directions. The IMU 60 is configured to transmit the obtained vehicle body tilting angle data to the blade controller 210 to be described.

The pair of sprocket wheels 70 is configured to be driven by the engine accommodated in the engine compartment 12. The drive unit 20 is configured to be rotated in conjunction with driving of the pair of sprocket wheels 70.

The driving torque sensor 80 is configured to obtain driving toque data indicating driving torque of the pair of sprocket wheels 70. The driving torque sensor 80 is configured to transmit the obtained driving torque data to the blade controller 210.

Structure of Blade Control System 200

Figure 2:
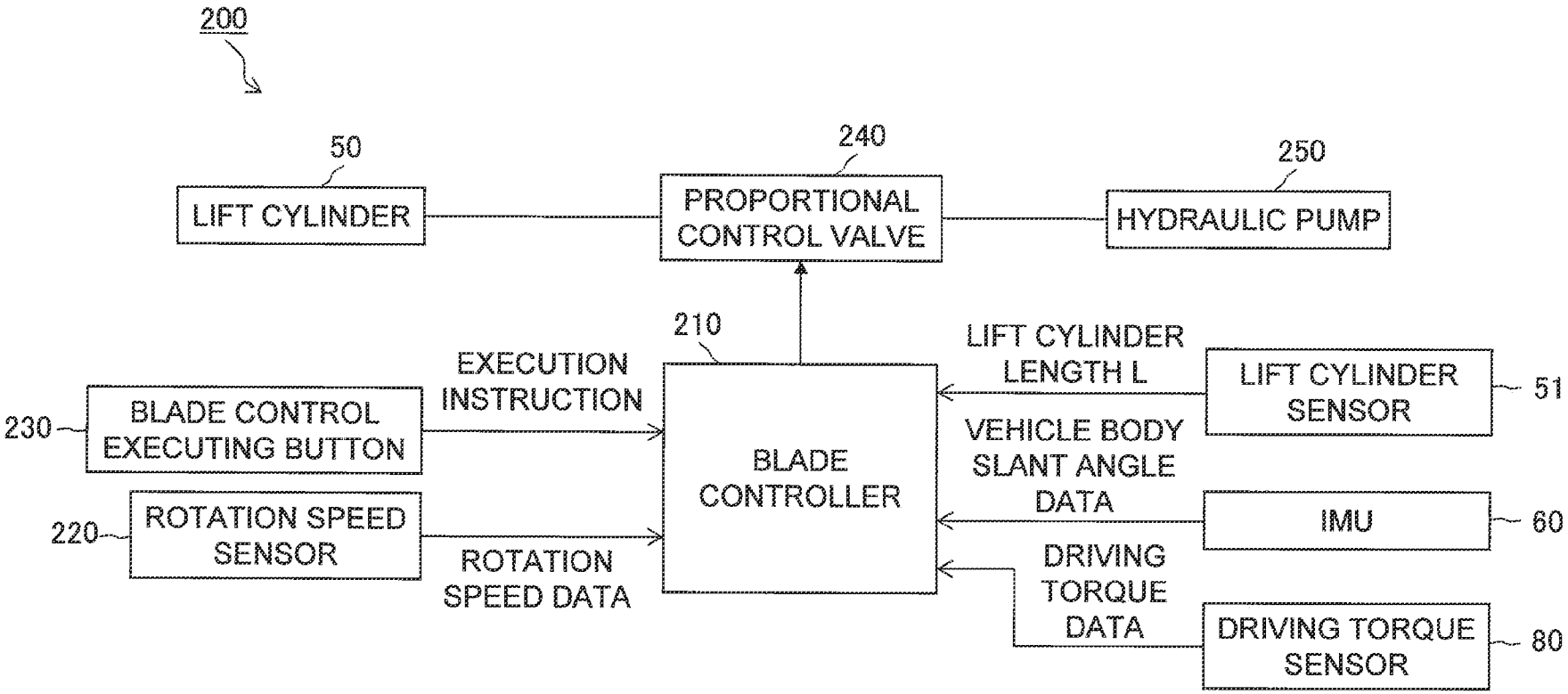
FIG. 2 is a configuration block diagram of a blade control system.

FIG. 2 is a configuration block diagram of the blade control system 200 according to the present exemplary embodiment.

The blade control system 200 includes the blade controller 210, a rotation speed sensor 220, a blade control executing button 230, a proportional control valve 240 and a hydraulic pump 250.

The rotation speed sensor 220 is configured to detect the rotation speed of the pair of sprocket wheels 70. The rotation speed sensor 220 is configured to transmit rotation speed data indicating the rotation speed of the pair of sprocket wheels 70 to the blade controller 210.

The blade control executing button 230 is disposed within the cab 11 and configured to receive an instruction of starting execution of a blade control from an operator. When receiving the instruction of starting execution of the blade control, the blade control executing button 230 is configured to transmit a blade control executing instruction to the blade controller 210.

The blade controller 210 is configured to output a command value to the proportional control valve 240 based on the lift cylinder length L received from the lift cylinder sensor 51, the vehicle body tilting angle data received from the IMU 60, the driving torque data received from the driving torque sensor 80, the rotation speed data received from the rotation speed sensor 220 and the blade control executing instruction received from the blade control executing button 230. Functions and actions of the blade controller 210 will be hereinafter described.

The proportional control valve 240 is disposed between the lift cylinder 50 and the hydraulic pump 250. The opening ratio of the proportional control valve 240 is configured to be controlled by the command value outputted from the blade controller 210.

The hydraulic pump 250 is configured to be operated in conjunction with the engine and configured to supply hydraulic oil to the lift cylinder 50 via the proportional control valve 240. It should be noted that the amount of the hydraulic oil to be supplied from the hydraulic pump 250 to the lift cylinder 50 is set in accordance with the opening ratio of the proportional control valve 240.

Functions of Blade Controller 210

Figure 3:
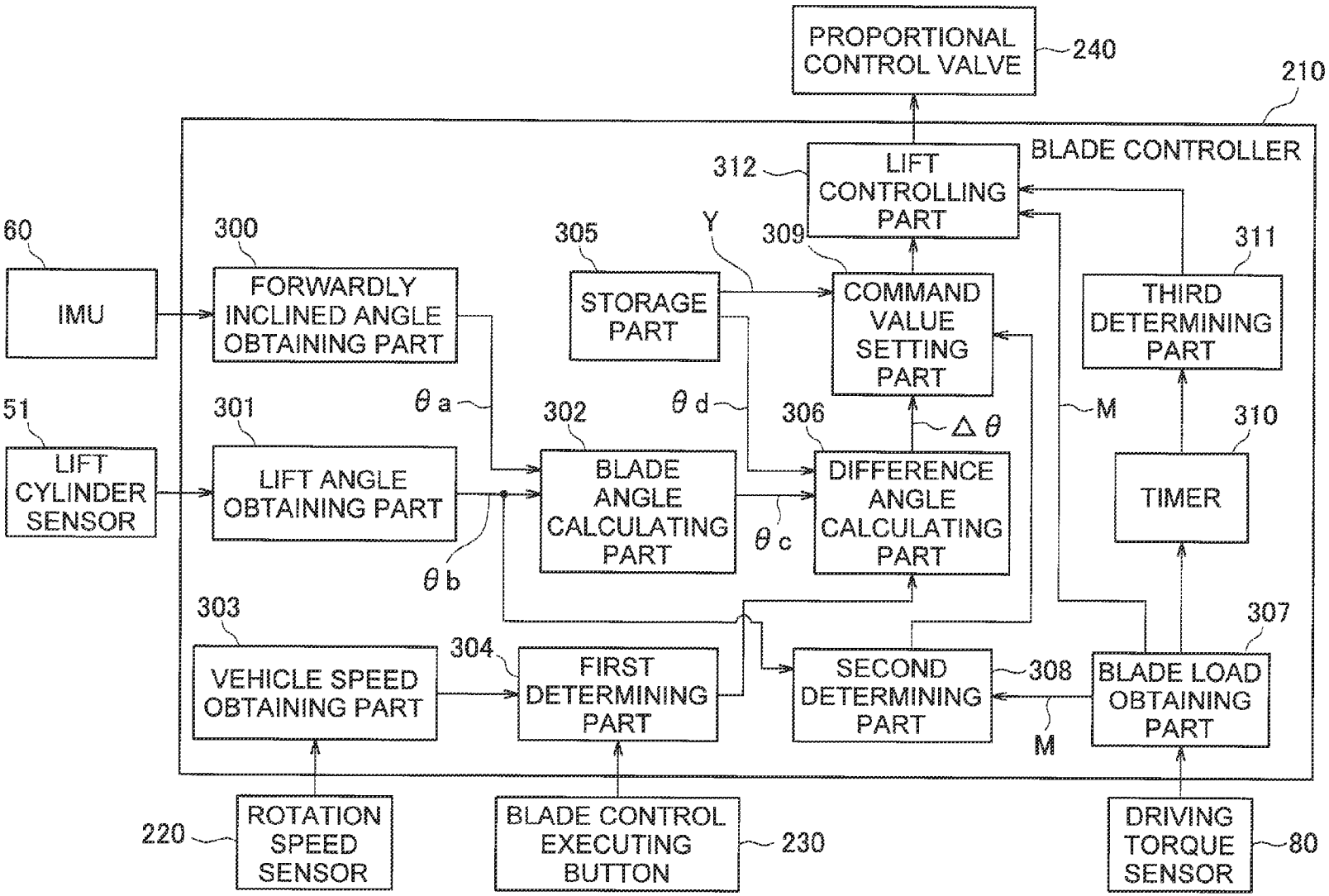
FIG. 3 is a functional block diagram of a blade controller.
Figure 4:
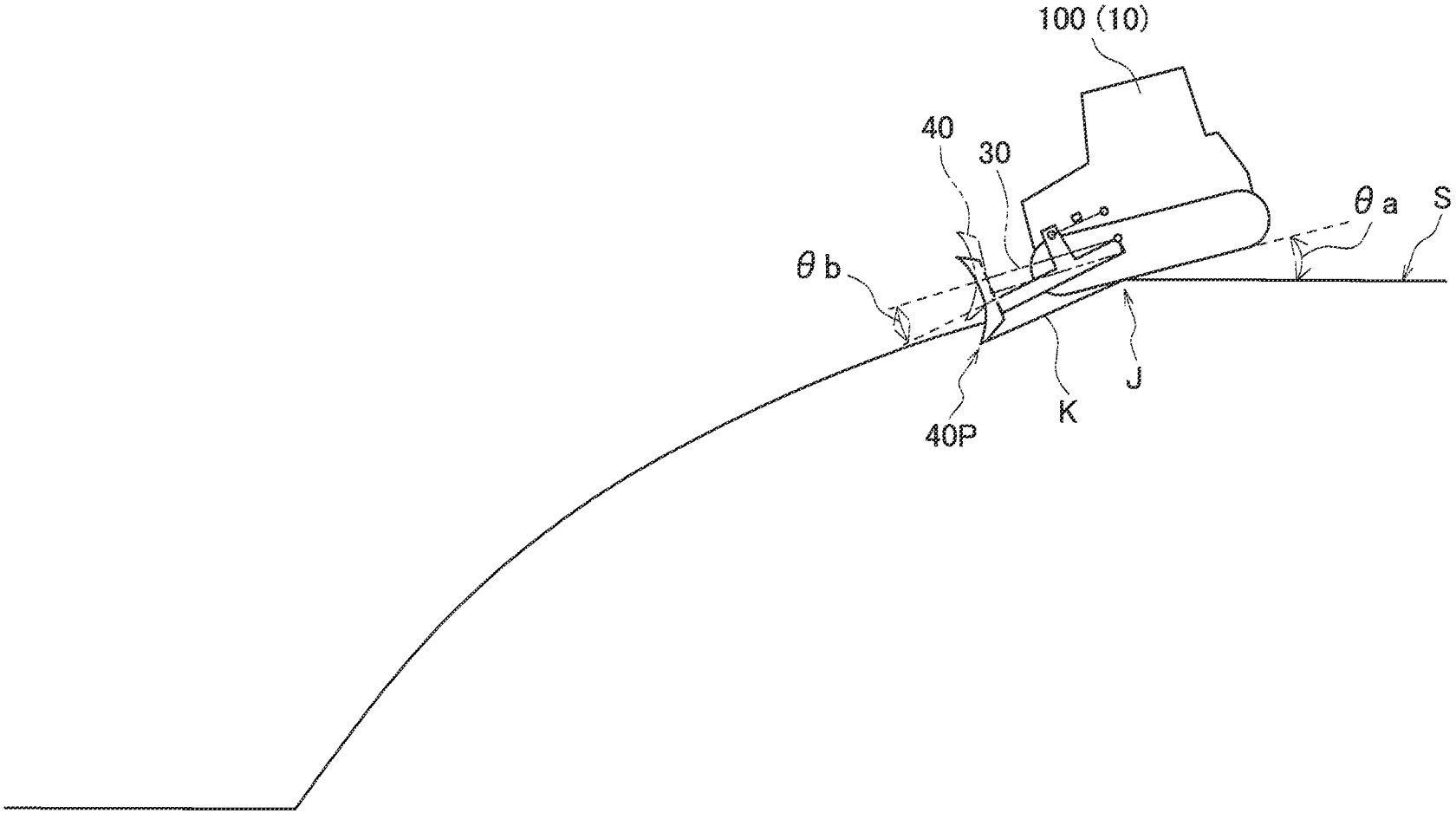
FIG. 4 is a schematic diagram illustrating a state of the bulldozer immediately after the onset of dozing.

FIG. 3 is a functional block diagram of the blade controller 210. FIG. 4 is a schematic diagram illustrating a state of the bulldozer 100 immediately after the onset of dozing.

As represented in FIG. 3, the blade controller 210 includes a forwardly tilting angle obtaining part 300, a blade lifting angle obtaining part 301, a blade angle calculating part 302, a vehicle speed obtaining part 303, a first determining part 304, a storage part 305, a difference angle calculating part 306, a blade load obtaining part 307, a second determining part 308, a command value setting part 309, a timer 310, a third determining part 311 and a lift controlling part 312.

The forwardly tilting angle obtaining part 300 is configured to calculate a forwardly tilting angle θa of the vehicle body 10 with respect to a reference surface S illustrated in FIG. 4 based on the vehicle body tilting angle data received from the IMU 60. The reference surface S may be set as the ground on which the bulldozer 100 is placed for starting dozing, but the reference surface S may be set as the ground on which the bulldozer 100 is positioned in actually starting dozing. Once dozing is started, as illustrated in FIG. 4, a dug slope K is formed ahead of the bulldozer 100 from a starting point J of dozing into which the cutting edge 40P of the blade 40 is shoved for the first time. In entering the dug slope K from the reference surface S, the bulldozer 100 slants when the center of inertia of the bulldozer 100 gets across the dozing starting point J. The forwardly tilting angle obtaining part 300 is configured to obtain the forwardly tilting angle θa of the vehicle body 10 at this time.

The blade lifting angle obtaining part 301 is configured to calculate a blade lifting angle θb of the blade 40 illustrated in FIG. 4 based on the lift cylinder length L received from the lift cylinder sensor 51. As illustrated in FIG. 4, the blade lifting angle θb corresponds to a downward angle from the reference position of the lift frame 30, i.e., the depth of the cutting edge 40P shoved into the ground. In FIG. 4, "the reference position" of the lift frame 30 is depicted with a dashed dotted line, while "the present position" of the lift frame 30 is depicted with a solid line. The reference position of the lift frame 30 herein refers to the position of the lift frame 30 under the condition that the cutting edge 40P makes contact with the reference surface S.

Figure 5:
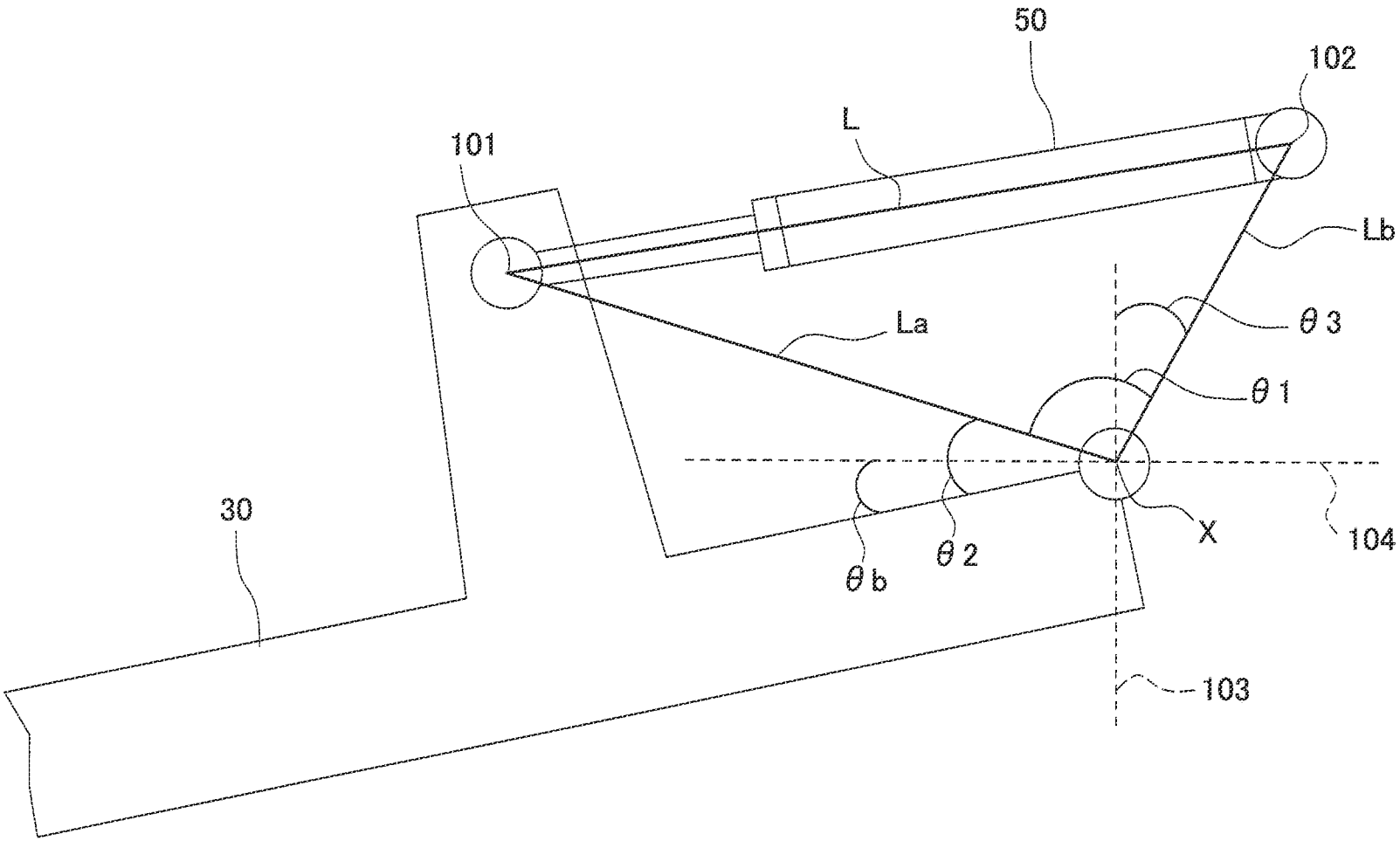
FIG. 5 is a partially enlarged view of FIG. 1.

Now, FIG. 5 is a partially enlarged view of FIG. 1 and schematically explains a method of calculating the blade lifting angle θb. As represented in FIG. 5, the lift cylinder 50 is attached to the lift frame 30 while being pivotable about a front-side rotary axis 101 and attached to the vehicle body 10 while being rotatable about a rear-side rotary axis 102. FIG. 5 depicts a vertical line 103 which is a straight line arranged along the vertical direction and an original position indicating line 104 which is a straight line indicating the original position of the blade 40. Further, a first length La is the length of a straight line segment connecting the front-side rotary axis 101 and the axis X of the lift frame 30, whereas a second length Lb is the length of a straight line segment connecting the rear-side rotary axis 102 and the axis X of the lift frame 30. Further, a first angle θa is formed between the front-side rotary axis 101 and the rear-side rotary axis 102 around the axis X as the vertex of the first angle $\theta_1$, and a second angle $\theta_2$ is formed between and the front-side rotary axis 101 and the upper face of the lift frame 30 around the axis X as the vertex of the first angle $\theta_2$, and a third angle $\theta_3$ is formed between the rear-side rotary axis 102 and the vertical line 103 around the axis X as the vertex of the first angle $\theta_3$. The first length La, the second length Lb, the second angle $\theta_2$ and the third angle $\theta_3$ are fixed values and are stored in the angle obtaining part 210. Radian is herein set as the unit for the second angle $\theta_2$ and that of the third angle $\theta_3$.

First, the blade lifting angle obtaining part 301 is configured to calculate the first angle $\theta_1$ using the following equations (1) and (2) based on the law of cosines.

$$L^2=La^2+Lb^2-2LaLb\times\cos(\theta_1) \quad (1)$$

$$\theta_1=\cos^{-1}((La^2+Lb^2-L^2)/2LaLb) \quad (2)$$

Next, the blade lifting angle obtaining part 301 is configured to calculate the blade lifting angle θb using the following equation (3).

$$\theta b=\theta_1+\theta_2-\theta_3-\pi/2 \quad (3)$$

The blade angle calculating part 302 is configured to calculate sum of the forwardly tilting angle θa of the vehicle body 10 and the blade lifting angle θb of the lift frame 30 (hereinafter referred to as "a blade angle θc"). In other words, the relation "θc=θa+θb" is established, and the blade angle θc is the blade lifting angle of the blade 40 with respect to the reference surface S.

The vehicle speed obtaining part 303 is configured to calculate the vehicle speed of the bulldozer 100 based on the rotation speed data received from the rotation speed sensor 220.

The first determining part 304 is configured to determine whether or not the vehicle speed calculated by the vehicle speed obtaining part 303 is greater than "0", and simultaneously, the blade control executing instruction is received from the blade control executing button 230.

The storage part 305 stores a variety of information used for controls by the blade controller 210. Specifically, the storage part 305 stores a target blade angle θd. The target blade angle θd is an angle suitable for shoving the blade 40 into the ground on the onset of dozing. In the present exemplary embodiment, the target blade angle θd can be set to be an angle downwardly shifted at several degrees (e.g., −3 degrees) from the reference position of the lift frame 30, but the target blade angle θd is not limited to the above and may be set to be the reference position of the lift frame 30.

Figure 6:
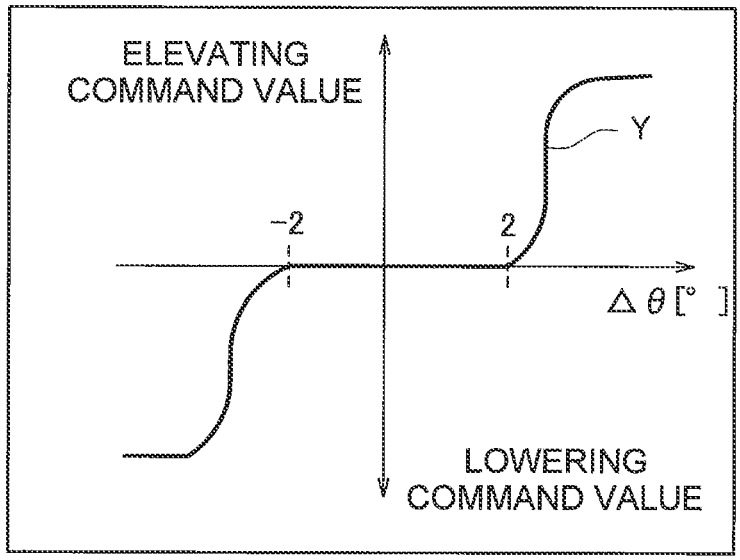
FIG. 6 is a map representing relation between difference angle and command value outputted to a proportional control valve.

Further, the storage part 305 stores a map represented in FIG. 6. A gain curve Y defines relation between a difference angle Δθ to be described and a command value transmitted to the proportional control valve 240.

The difference angle calculating part 306 is configured to calculate the difference angle Δθ by subtracting the target blade angle θd from the blade angle θc. In other words, the relation "Δθ=θc−θd" is established.

The blade load obtaining part 307 is configured to calculate a load acting on the blade 40 (hereinafter referred to as "a blade load M") based on the driving torque data received from the driving torque sensor 80. The blade load M can be referred to as either "dozing resistance" or "traction force".

The second determining part 308 is configured to determine whether or not the blade lifting angle θb is greater than "0", and simultaneously, the blade load M is less than 0.2 W (W herein refers to the vehicle weight of the bulldozer 100).

The command value setting part 309 (an exemplary opening ratio setting part) is configured to set either an elevating command value or a lowering command value based on the difference angle Δθ with reference to the map represented in FIG. 6. The elevating/lowering command value corresponds to the open ratio of the proportional control valve 240. As is obvious from the gain curve Y represented in FIG. 6, the command value setting part 309 is configured to set the elevating command value when the difference angle Δθ is greater than or equal to 2 degrees, whereas the command value setting part 309 is configured to set the lowering command value when the difference angle Δθ is less than or equal to −2 degrees. This means that the lift control is configured to be executed for setting the blade angle θc to fall in a range of θd±2 degrees. It should be noted that the range for setting the command value to be "0" is not limited to ±2 degrees and may be arbitrarily set.

Further, the command value setting part 309 is configured to increase the once set lowering command value when the second determining part 308 determines that the blade lifting angle θb is greater than "0" and simultaneously the blade load M is less than 0.2 W. The command value setting part 309 may be herein configured to increase the lowering command value to a value for fully opening the proportional control valve 240.

The timer 310 is configured to count an elapsed time from the onset of dozing and a continued time while the blade load M is greater than a predetermined threshold (e.g., 0.35 W). The timer 310 may be configured to use, as the timing of starting dozing, the timing when the blade control executing button 230 receives the instruction of starting execution of the blade control.

The third determining part 311 is configured to determine whether or not the counted time by the timer 310 exceeds a predetermined period of time (e.g., 0.5 seconds).

The lift controlling part 312 is configured to output either the elevating command value or the lowering command value, which is set by the command value setting part 309, to the proportional control valve 240 when the third determining part 311 does not determine that the counted time by the timer 310 exceeds the predetermined period of time. Accordingly, the blade lifting angle θb is regulated for allowing the sum of the forwardly tilting angle θa of the vehicle body 10 and the blade lifting angle θb of the lift frame 30 (i.e., the blade angle θc) to fall in a predetermined range (−5 degrees≤θc≤−1 degrees).

The lift controlling part 312 is configured to control the opening ratio of the proportional control valve 240 in accordance with a difference between a target load and the blade load M obtained by the blade load obtaining part 307 when the third determining part 311 determines that the counted time by the timer 310 exceeds the predetermined period of time. In other words, the lift controlling part 312 is configured to regulate the blade lifting angle θb in accordance with the blade load M regardless of magnitude of the blade angle θc when the counted time exceeds the predetermined period of time. It should be noted that the target load may be herein set to be in a range from 0.4 W to 0.7 W.

Actions of Blade Controller 210

Figure 7:
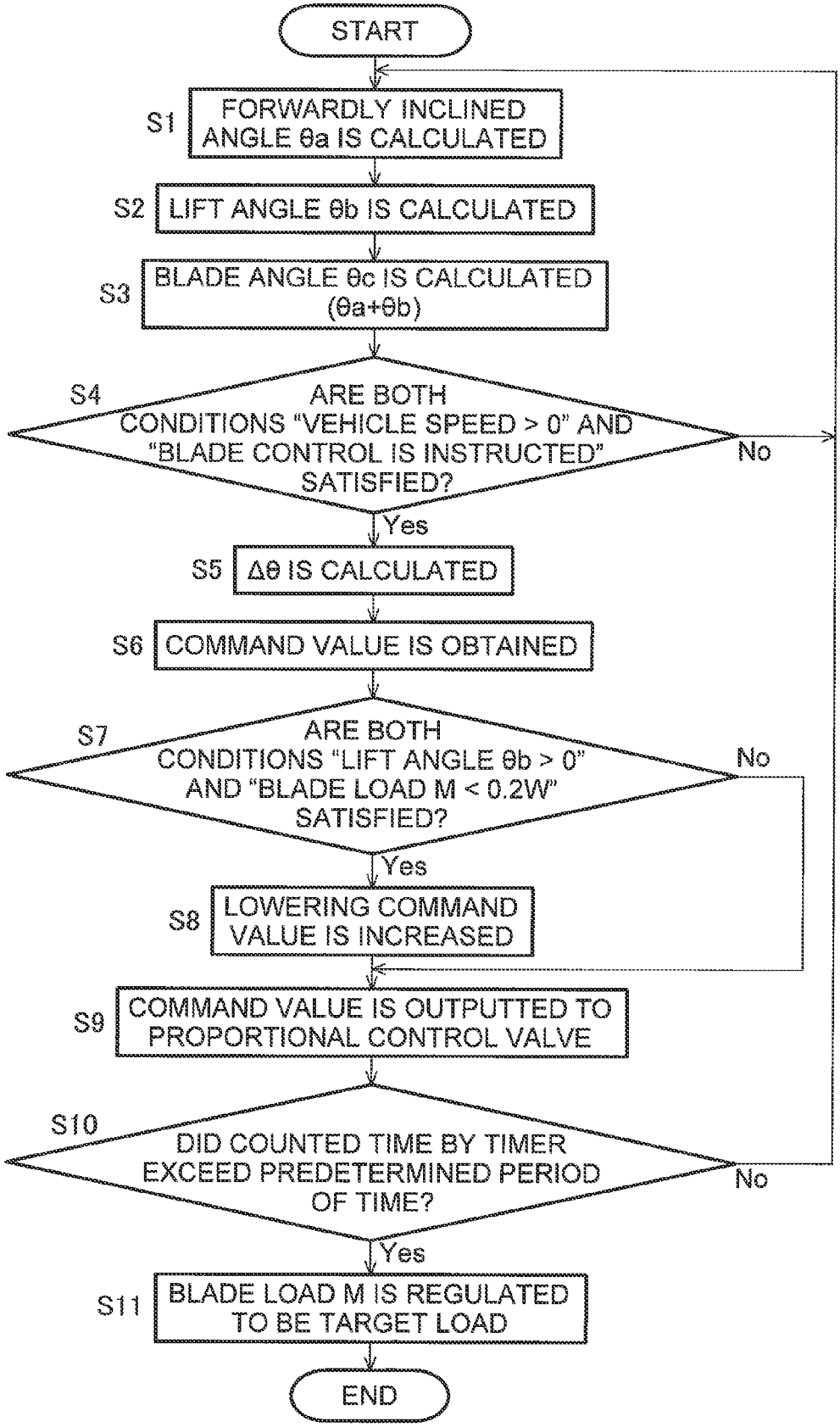
FIG. 7 is a flowchart for explaining actions of the blade controller.

FIG. 7 is a flowchart for explaining actions of the blade controller 210.

First in Step S1, the blade controller 210 calculates the forwardly tilting angle θa of the vehicle body 10 with respect to the reference surface S based on the vehicle body tilting angle data obtained from the IMU 60.

Next in Step S2, the blade controller 210 calculates the blade lifting angle θb of the blade 40 based on the lift cylinder length L obtained from the lift cylinder sensor 51.

Next in Step S3, the blade controller 210 calculates the sum of the forwardly tilting angle θa and the blade lifting angle θb (i.e., the blade angle θc).

Next in Step S4, the blade controller 210 determines whether or not the vehicle speed is greater than "0", and simultaneously, the blade control executing instruction is received. The processing proceeds to Step S5 when both of the conditions are satisfied. By contrast, the processing returns to Step S1 when at least either of the conditions is not satisfied.

Next in Step S5, the blade controller 210 calculates the difference angle Δθ between the blade angle θc and the target blade angle θd. Next in Step S6, the blade controller 210 sets either the elevating command value or the lowering command value based on the difference angle Δθ with reference to the gain curve Y represented in the map of FIG. 6.

Next in Step S7, the blade controller 210 determines whether or not the blade lifting angle θb is greater than "0" (i.e., whether or not the blade is positioned in the air without making contact with the ground), and simultaneously, the blade load M is less than 0.2 W (i.e., the blade load is small). The processing proceeds to Step S8 when the both of the conditions are satisfied. By contrast, the processing proceeds to Step S9 when at least either of the conditions is not satisfied.

Next in Step S8, the blade controller 210 increases the lowering command value obtained in Step S6.

Next in Step S9, the blade controller 210 outputs either the elevating command value or the lowering command value to the proportional control valve 240. Accordingly, the hydraulic oil is supplied from the proportional control valve 240 to the lift cylinder 50, and the blade lifting angle θb is thereby regulated for allowing the sum of the forwardly tilting angle θa of the vehicle body 10 and the blade lifting angle θb of the lift frame 30 (i.e., the blade angle θc) to fall in the predetermined angular range (−5 degrees≤θc≤−1 degrees).

Next in Step S10, the blade controller 210 determines whether or not the counted time by the timer 310 exceeds the predetermined period of time. The processing proceeds to Step S10 when the counted time by the timer 310 exceeds the predetermined period of time. By contrast, the processing returns to Step S1 when the counted time by the timer 310 does not exceed the predetermined period of time. The counted time by the timer 310 herein refers to either the elapsed time from the onset of dozing or the continued time while the blade load M is greater than a predetermined threshold.

Next in Step S11, the blade controller 210 controls the open ratio of the proportional control valve 240 for allowing the blade load M to get closer to a target load regardless of magnitude of the blade angle θc.

Working Effects (1) In the present exemplary embodiment, the blade controller 210 is configured to regulate the blade lifting angle θb on the onset of dozing for allowing the sum of the forwardly tilting angle θa of the vehicle body 10 and the blade lifting angle θb of the lift frame 30 (i.e., the blade angle θc) to fall in the predetermined angular range (−5 degrees≤θc≤−1 degrees).

Accordingly, since the blade control is thus executed in consideration of the forwardly tilting angle θa, the blade 40 can be promptly and appropriately elevated when the bulldozer 100 enters the dug slope K and forwardly slants. Therefore, since the blade load M can be inhibited from being abruptly increased due to the blade 40 deeply shoved into the ground, abrupt driving of the blade 40 can be further inhibited compared to the case that the blade control is executed only in accordance with the blade load M. Consequently, since it is possible to inhibit sand and earth from being scattered around the bulldozer 100, dozing can be efficiently executed.

(2) The blade controller 210 is configured to lower the lift frame 30 on the onset of dozing for allowing the blade angle θc to be the target blade angle θd (an exemplary predetermined angle).

Therefore, dozing can be efficiently executed immediately after the onset of dozing through the appropriate setting of the target blade angle θd.

(3) The blade controller 210 is configured to increase the lowering command value for increasing the open ratio of the proportional control valve 240 when the blade lifting angle θb is greater than "0" and simultaneously the blade load M is less than 0.2 W (an exemplary predetermined value).

Therefore, the blade 40 can be promptly lowered and dozing can be more efficiently executed.

(4) The blade controller 210 is configured to control the opening ratio of the proportional control valve 240 for allowing the blade load M to get closer to the target load when either the elapsed time from the onset of dozing or the continued time while the blade load M is greater than a predetermined threshold is continued for a predetermined period of time (e.g., 0.5 seconds) or greater.

Therefore, scattering of earth and sand can be inhibited immediately after the onset of dozing, and thereafter, dozing can be efficiently executed.

Other Exemplary Embodiments

An exemplary embodiment of the present invention has been explained above, but the present invention is not limited to the aforementioned exemplary embodiment, and a variety of changes can be herein made without departing from the scope of the present invention.

(A) A variety of numeric values, specified in the aforementioned exemplary embodiment, are exemplary only and may be arbitrarily set.

(B) In the aforementioned exemplary embodiment, the gain curve Y is exemplified in FIG. 6, but the feature of the gain curve Y is not limited to the above. For example, the shape of the gain curve Y may be arbitrarily set.

(C) In the aforementioned exemplary embodiment, the blade load is configured to be calculated based on the driving torque data, but the calculation method of the blade load is not limited to the above. For example, the blade load can be obtained by multiplying engine torque by a sprocket diameter and a reduction ratio in a transmission, a steering mechanism and a final reduction gear mechanism.

(D) In the aforementioned exemplary embodiment, the bulldozer has been explained as an exemplary "construction machine", but the construction machine is not limited to a bulldozer, and may be any suitable construction machines such as motor graders.

(E) In the aforementioned exemplary embodiment, the present invention is applied to the case that the bulldozer 100 dozes an object while travelling on a downslope as illustrated in FIG. 4, but the application of the present invention may not be limited to the above. For example, the present invention may be applied to a case that the bulldozer 100 dozes an object while travelling on an upslope.

DESCRIPTION OF THE NUMERALS

10 . . . vehicle body, 11 . . . cab, 12 . . . engine compartment, 20 . . . drive unit, 30 . . . lift frame, 31 . . . ball-and-socket joint0, 40 . . . blade, 41 . . . universal coupling, 50 . . . lift cylinder, 51 . . . lift cylinder sensor, 60 . . . IMU, 70 . . . pair of sprocket wheels, 80 . . . driving torque sensor, 100 . . . bulldozer, 200 . . . blade control system, 210 . . . blade controller, 220 . . . rotation speed sensor, 230 . . . blade control executing button, 240 . . . proportional control valve, 250 . . . hydraulic pump, θa . . . forwardly tilting angle, θb . . . blade lifting angle, θc . . . blade angle, θd . . . target blade angle, Δθ . . . difference angle, J . . . starting point, K . . . dug slope, L . . . lift cylinder length, M . . . blade load, S . . . reference surface, W . . . vehicle weight of the bulldozer 100

What is claimed is:

1. A blade control system, comprising:

a lift frame vertically pivotably attached to a vehicle body;

a blade attached to a tip of the lift frame;

a lift cylinder configured to vertically drive the lift frame;

a control valve configured to supply hydraulic oil to the lift cylinder;

a blade angle calculating part configured to calculate sum of a forwardly tilting angle of the vehicle body with respect to a reference surface and a blade lifting angle of the lift frame with respect to a reference position;

a difference angle calculating part configured to calculate a difference angle by subtracting a predetermined angle from the sum of the forwardly tilting angle and the blade lifting angle;

an opening ratio setting part configured to set an opening ratio of the control valve based on the difference angle; and a lift controlling part configured to control the control valve in accordance with the opening ratio set by the opening ratio setting part until a predetermined period of time is elapsed from an onset of dozing by the blade.

2. The blade control system according to claim 1, further comprising:

a determining part configured to determine whether or not the lift frame is positioned higher than the reference position and simultaneously a load acting on the blade is less than a predetermined value, wherein when the dozing by the blade is actually started and the determining part determines that the lift frame is positioned higher than the reference position and simultaneously the load acting on the blade is less than the predetermined value, the opening ratio setting part is configured to set the opening ratio of the control valve to be greater than the opening ratio set when the determining part determines that the lift frame is not positioned higher than the reference position or the load acting on the blade is not less than the predetermined value.

3. The blade control system according to claim 1, further comprising:

a blade load obtaining part configured to obtain a blade load acting on the blade, wherein the lift controlling part is configured to control the open ratio of the control valve in accordance with a difference between the blade load and a target load after the predetermined period of time is elapsed from the onset of dozing by the blade.

4. The blade control system according to claim 1, further comprising:

a blade load obtaining part configured to obtain a blade load acting on the blade, wherein the lift controlling part is configured to control the opening ratio of the control valve in accordance with a difference between the blade load and a target load when the blade load is greater than a predetermined threshold continuously for a predetermined period of time from the onset of dozing by the blade.

5. A construction machine, comprising:

a vehicle body; and the blade control system according to claim 1.

6. The construction machine according to claim 5, further comprising:

a drive unit including a pair of tracks attached to the vehicle body.

7. A blade control method of regulating a blade lifting angle of a lift frame vertically pivotably attached to a vehicle body with respect to a reference position for allowing sum of the blade lifting angle and a forwardly tilt angle of the vehicle body with respect to a reference surface to fall in a predetermined angular range until a predetermined period of time is elapsed from an onset of dozing by a blade attached to a tip of the lift frame.

8. The blade control method according to claim 7, wherein the lift frame is lowered for allowing the sum of the blade lifting angle and the forwardly tilt angle to be a predetermined angle until the predetermined period of time is elapsed from the onset of dozing by the blade.

* * * * *